United States Patent [19]

Robinson

[11] Patent Number: 4,627,909

[45] Date of Patent: Dec. 9, 1986

[54] DUAL RECYCLE PRESSURE-STEP REFORMER WITH CYCLIC REGENERATION

[75] Inventor: Richard C. Robinson, San Rafael, Calif.

[73] Assignee: Chevron Research Company, San Francisco, Calif.

[21] Appl. No.: 730,698

[22] Filed: May 2, 1985

[51] Int. Cl.[4] ..... C10G 35/06

[52] U.S. Cl. ..... 208/65; 208/138

[58] Field of Search ..... 208/65, 138; 585/419

[56] References Cited

U.S. PATENT DOCUMENTS

| | | | |
|---|---|---|---|
| 3,397,137 | 8/1968 | Pickert et al. | 208/138 |
| 3,748,255 | 7/1973 | Cassidy et al. | 208/65 |
| 4,425,222 | 1/1984 | Swan | 208/65 |
| 4,456,527 | 6/1984 | Buss et al. | 208/89 |

*Primary Examiner*—Curtis R. Davis

*Attorney, Agent, or Firm*—S. R. La Paglia; W. K. Turner

[57] ABSTRACT

A catalytic reforming process comprising at least two reforming zones each having a separate recycle gas system, the first reforming zone operated at conventional low pressure reforming conditions and the second reforming zone operated at a total pressure stepped below that of the first reforming zone, thereby increasing the overall selectivity and yield of the reforming process.

3 Claims, 1 Drawing Figure

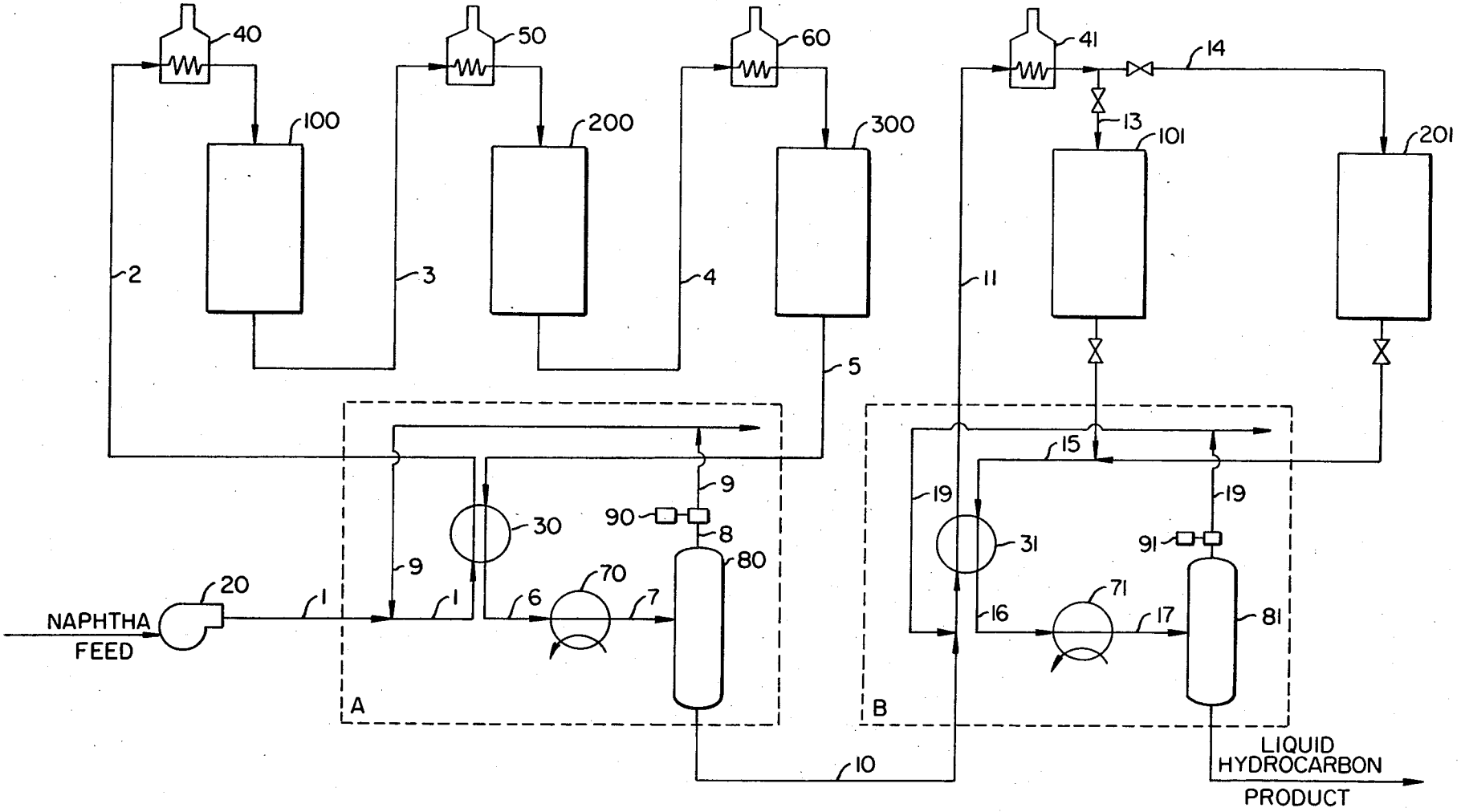
LIQUID HYDROCARBON PRODUCT
NAPHTHA FEED
A
B
1
2
3
4
5
6
7
8
9
10
11
13
14
15
16
17
19
20
30
31
40
41
50
60
70
71
80
81
90
91
100
101
200
300
201

DUAL RECYCLE PRESSURE-STEP REFORMER WITH CYCLIC REGENERATION

BACKGROUND OF THE INVENTION

This invention relates to low pressure reforming. In particular, this invention relates to low pressure reforming of a full-boiling-range hydrocarbon comprising naphthenes and paraffins boiling primarily in the gasoline of naphtha range. The low pressure reforming process described in detail below comprises at least two reforming zones each having a separate recycle gas system enabling process operations in the second zone to be conducted at higher than normal $C_5+$ reformate selectivity, especially when reforming naphthas containing relatively high amounts of $C_6$ and $C_7$ paraffins.

Catalytic reforming of hydrocarbon naphtha feeds to produce high octane gasoline products was developed as a relatively high pressure process. High pressures, greater than 350 psig, helped to limit those reactions such as condensation and polymerization, which resulted in coke formation on the catalyst. As a consequence, high pressure reforming permitted long on-stream periods of operation between replacement or regeneration of the catalyst. However, there are disadvantages to high pressure reforming. At high pressures, reactions which adversely affect the yield of valuable $C_5+$ products are more prevalent. In particular, in high pressure reforming hydrocracking reactions are favored, thus producing less valuable light gases.

In response to the disadvantages of high pressure reforming several low pressure reforming processes have been developed and are commercially available. In particular, development of regenerative bimetallic catalysts, for example, platinum-rhenium catalysts, allows the use of reforming pressures well below 350 psig. Using these bimetallic catalysts, e.g., Pt-Re in semi-regenerative (long cycle) reformers, pressures in the vicinity of 200 psig are commonly employed. In addition, the use of continuous regeneration and swing reactor schemes permit operation substantially below 200 psig with the relatively short cycles between regenerations. In order to control catalyst fouling at low pressures, high hydrogen to hydrocarbon mole ratios have been suggested. However, a high hydrogen to hydrocarbon mole ratio requires extra gas handling equipment, for instance, very large recycle gas compressors. Moreover, operating at pressures below about 150 psig can require booster compressors to increase the pressure of the net hydrogen gas produced in order to transport it to other units. Accordingly, low pressure reforming loses some of its economic advantage due to frequent regeneration or high capital investment costs. U.S. Pat. No. 3,716,477 which issued Feb. 13, 1973 to R. L. Jacobson and R. D. Vanselow describes previous attempts to provide an attractive low pressure reforming process using a regenerative bimetallic catalyst.

One process configuration which has been suggested for low pressure reforming is known as "pressure-step" reforming. In this configuration two or more reforming zones are closely coupled, in series, with each subsequent zone operated at a pressure below that of the preceding zone. U.S. Pat. No. 4,002,555 which issued on Jan. 11, 1977 to R. A. Farnham describes a pressure-step reforming process. In the configuration suggested in this patent the hydrocarbon feedstock is separated into two fractions, a high-boiling fraction and a low-boiling fraction. The fractions are contacted with hydrogen in two separate reforming zones. The high-boiling fraction is processed in a first zone operated at a relatively high pressure, above 175 psig, and the low-boiling fraction is processed in a second zone operated at a lower pressure, below 150 psig. Recycle gas from the first zone is circulated to both zones using a single compressor.

Another process configuration which has been suggested for low pressure reforming is known as "swing reactor" or "cyclic regeneration" reforming. As the names imply, this configuration employs two or more parallel reactors, any one of which can be taken off line for catalyst regeneration without shutting down the unit.

The present invention provides an improved low pressure reforming process which advantageously combines the benefits of pressure-step reforming and swing reactor reforming.

SUMMARY OF THE INVENTION

The central feature of the present invention resides in the use of a dual recycle gas system in a low pressure, pressure-step reforming unit to achieve improved yields of $C_5+$ reformate and hydrogen. According to the present invention a catalytic, low pressure, reforming process comprising a first reforming zone operated at conventional low pressure conditions, i.e., a pressure below about 350 psig and above about 150 psig, and a second reforming zone operated at a pressure below that of the first reforming zone will provide better reforming selectivity and yield when each reforming zone additionally comprises a separate gas recycle system. Each recycle system typically comprises a product separator, a recycle compressor, heating means, and cooling means. Preferably, each reforming zone additionally comprises a sulfur removal system.

The process may be regenerative. The operating conditions of the second reforming zone probably will result in relatively shorter run lengths for the catalyst in this reforming zone. However, by utilizing a large pore zeolitic type catalyst and/or bimetallic Pt-Re catalyst and by periodically regenerating the second reforming zone catalyst using parallel reactors the entire process can be operated for a relatively long period until regeneration of the first reforming zone catalyst is required.

BRIEF DESCRIPTION OF THE DRAWING

The present invention can be better understood and is detailed hereinafter with reference to the accompanying drawing. The drawing represents a preferred process configuration embodying the features of the present invention. Each recycle gas system, essential to achieving the advantages claimed for this invention, is delineated by dashed lines, and labeled A and B respectively. The second reforming zone comprises two parallel swing reactors to allow cyclic regeneration.

DETAILED DESCRIPTION OF THE INVENTION

The process of the present invention provides a method for improving the selectivity and yield of low pressure reforming operations. It is especially useful when reforming paraffinic naphthas containing more than the usual amount of $C_6$ and $C_7$ paraffins. In this process a pressure-step reforming unit comprising at least two reforming zones is improved by equipping each zone with a separate recycle gas system and by operating the second reforming zone at a relatively lower pressure than the first reforming zone resulting in higher selectivity and yield. As a consequence of the lower pressure operations the second reforming zone catalyst will have an increased fouling rate relative to the first reforming zone catalyst. Accordingly, the second zone comprises at least two parallel reactors permitting periodic regeneration of the catalyst in each reactor while the remaining reactor continues to operate.

As used herein the term "pressure-step reforming" refers to reforming operations carried out in two or more successive reforming zones. Each reforming zone may comprise two or more contact zones, i.e., reactors, each reforming zone in the sequence being operated at a pressure below that of the preceding reforming zone. In low pressure, pressure-step reforming, the first reforming zone is generally operated at a total pressure below about 350 psig, typically between about 150 psig and about 250 psig; and the last reforming zone is generally operated at a pressure below 150 psig, typically between 75 psig and 125 psig. The pressure of a reforming zone comprising a series of reactors is determined as the average reactor pressure. Thus, for example, a reforming zone having two or more reactors in series with the flow of feed from the outlet of one reactor directly to the inlet of another reactor will have a pressure determined as the average pressure of all of the reactors. In turn, the pressure of a reforming zone having parallel reactors is determined as the average pressure through a given reactor.

In view of the endothermic nature of catalytic reforming each reforming zone usually employs a series of adiabatic catalytic reactors. The reactors in each reforming zone representing a discrete contact zone. The reactors may be moving bed reactors wherein the catalyst is continuously circulated between a contact zone and a regeneration zone, or they may be fixed bed reactors wherein the catalyst is periodically regenerated either in situ of by removal from the reactor. In the process of the present invention it is preferable to use reactors in a four or five reactor system. The first two or three reactors comprising the first reforming zone, and the last two reactors comprising the second reforming zone. In such a reactor system the catalyst in the second reforming zone reactors, operating at a lowered pressure, will require more frequent regeneration. Thus, the second zone reactors are operated in parallel to provide "swing" or "cyclic" operations. In other words, each reactor in the second reforming zone should be capable of being removed or isolated from the system while the catalyst is regenerated, without discontinuing the flow of feed through the reactors in the first zone and the remaining reactor in the second zone. In a typical reforming operation the catalyst in the active second zone reactor will require regeneration about every one to three months, that is between about 660 on-stream hours and about 2000 on-stream hours. Normally the on-stream life of catalyst in the active second reforming zone reactor will not exceed about 1500 hours since, as detailed below, as an advantage of the present invention the second reforming zone can be operated at very low pressures where reforming selectivities are highest.

The feed to the first reforming zone may comprise a full-boiling-range naphtha feedstock. The present invention is not limited to a particular type of naphtha feedstock. It can be, for example, a straight-run naphtha, a hydrocracked or a thermally-cracked naphtha, a catalytically-cracked naphtha, or blends. Preferably, the naphtha is a straight run or hydrocracked naphtha, generally having a boiling range falling within the range of from about 100° F. to 450° F. and preferably within the range of from about 130° F. to 400° F. In general, naphtha feeds will preferably have a 95 volume percent cut point (by ASTM D-86 distillation) of from about 250° F. to 400° F. and even more preferably of from about 280° F. to 360° F. These feedstocks include gasoline boiling range hydrocarbons whether they boil over a broad or narrow temperature range. In such operations, a naphtha, a fraction thereof or other similar boiling range hydrocarbons whose aliphatic and cycloaliphatic constituents are for the most part saturated and which may contain some aromatics, is converted to a product having greater aromaticity and higher octane rating. Relatively pure aromatics can be separated from the products. The feeds employed in the process of the invention include naphthas composed of at least about 15 percent up to about 70 percent (by volume) naphthenes and at least about 25 percent paraffins and generally have clear or unleaded research octane ratings (RON) in the range of about 30 to 60. Advantageously, the total hydrocarbon feed and recycle gas passing to a given reactor of the invention contains less than about 2 ppm (by weight) sulfur, and preferably less than about 1 ppm combined nitrogen. Superior operations can be provided where the hydrocarbon feed and recycle gas stream to all reactors have less than about 0.5 ppm sulfur and less than about 0.5 ppm combined nitrogen. These impurity levels are based on the weight of total process materials passing to a given reactor.

During the reforming operation the naphtha feedstock is fed to the first reforming zone. The first reforming zone is operated at conventional low pressure reforming temperatures of from about 800° F. to about 1000° F., pressures of from about 150 psig to about 350 psig, hydrogen-hydrocarbon mole ratios of from about 2:1 to about 10:1, and liquid hourly space velocities (LHSV) of from about 0.5 to about 5.0. In a preferred operation the first reforming zone operating conditions include a temperature of from about 850° F. to about 980° F., a pressure of from about 200 psig to about 300 psig, a hydrogen-hydrocarbon mole ratio of from about 4:1 to about 8:1, and a LHSV of from about 1.0 to about 5.0.

Where the first reforming zone comprises a series of adiabatic reactors the temperature of the reforming zone refers to the inlet temperatures of each reactor. The temperature drop exhibited in each of a series of reactors progressively decreases in the direction of feed flow. Thus, while the temperature drop in the first reactor of a three reactor series may range from about 50° F. to about 150° F., the temperature drop in the terminal reactor may be as low as 25° F.

Reforming conditions in the second reforming zone are more severe than those in the first reforming zone. The catalyst volumes and LHSV in each zone will be chosen as appropriate based on feed properties. Catalyst temperatures can be adjusted as necessary in each zone to give the desired conversion. As previously stated, the second zone is operated at a lower pressure than the first reforming zone. In typical operations the pressure will be from about 50 psig to 150 psig, preferably from about 75 psig to 125 psig. However, at the lower pressure it will be desirable to decrease the hydrogen-hydrocarbon mole ratio. Operating at low pressures makes handling large volumes of hydrogen difficult. Accordingly, in the second reforming zone, it is preferable to operate at a hydrogen-hydrocarbon mole ratio below about 4:1, generally about 1:1 to 3:1. Therefore, for the purposes of the present invention some hydrogen is added to the second reforming zone, such that the hydrogen-hydrocarbon mole ratio is about 2:1. The presence of some added hydrogen will reduce coke deposition on the catalyst, and can be used to favor certain reforming reactions. For purposes of the present invention, the hydrogen-hydrocarbon mole ratio (for either reforming zone) is measured at the inlet of the reactor within the reforming zone, that is, in the case of plural reactors in series at the inlet of the first reactor.

Thus, the reaction in the initial reactors (the first reforming zone) is predominantly dehydrogenation, for instance, the conversion of naphthenes to aromatics, while the predominant reaction in the terminal reactor (the second reforming zone) is paraffin dehydrocyclization. In order to maintain a reasonably consistent temperature within each reforming zone it is typical to use fired preheaters before each reactor as well a indirect heat exchange before the first reactor, for instance with reformate product from the last reactor in this first reforming zone.

During the reforming operation hydrogen is supplied to each reforming zone by recycle of a portion of hydrogen-containing gases separated from that reforming zone's product effluent. As previously discussed recycled hydrogen when added to hydrogen produced in the reforming zone accounts for the hydrogen-hydrocarbon mole ratios necessary for reforming operations. In the first reforming zone a typical hydrogen-hydrocarbon mole ratio of from about 3:1 to about 10:1 is common, and a ratio of from about 4:1 to 8:1 is preferred.

As an essential feature of the present invention, each reforming zone is equipped with a separate hydrogen recycle system. Thus, the effluent from the first reforming zone is passed through conventional apparatus to separate a hydrogen-rich gas from the hydrocarbon product. A portion of the hydrogen-rich gas is drawn off as net $H_2$ and the remainder is then recycled to the first reforming zone and the hydrocarbon product is passed to the second reforming zone. For example, in a preferred embodiment of the present invention, hot effluent from the terminal reactor of the first reforming zone is passed through a conventional heat exchanger used to preheat the naphtha feedstock, is subsequently passed through a conventional cooler where it is partially condensed, and is finally separated into hydrogen-rich gas and hydrocarbon. The separation procedure is conventionally performed in a high pressure separator. After separation, the hydrogen-rich gas is compressed and a portion of said gas is drawn off as net product and the remainder is then recycled to the inlet of the first reactor of the first reforming zone. The liquid hydrocarbon is passed via a pressure control valve to the second reforming zone. The amount of hydrogen-rich gas which is recycled is simply the amount required to maintain the desired pressure and hydrogen-hydrocarbon mole ratio in the first reforming zone.

The hydrogen recycle system of the second reforming zone is essentially the same as that of the first reforming zone, except that the separator is operated at a lower pressure. Thus, hydrocarbon effluent from the separator of the first reforming zone is passed to the inlet of the first reactor in the second reforming zone. In a preferred embodiment of the present invention the second zone feed from the first zone is passed through a heat exchanger to preheat it and subsequently a fired preheater. Effluent from the second zone is heat exchanged with the feed in an arrangement parallel to that of the first reforming zone. Similarly, the second zone effluent is cooled and finally separated into a second zone hydrogen-rich recycle gas and hydrocarbon product. A portion of the hydrogen-rich gas is drawn off as net $H_2$ and the remainder is recycled to the second reforming zone. The hydrocarbon product can be further processed and is useful as a gasoline blending stock or a petrochemical feedstock.

By equipping each of the reforming zones with a separate recycle system it is possible to operate the second reforming zone under conditions of higher selectivity and yield, especially when feeding light paraffinic naphthas containing more than the usual amount of $C_6$ and $C_7$ molecules. In addition, the separate recycle system for the second reforming zone provides a means for excluding sulfur from the second zone reforming operation by the addition of a sulfur removal system in front of the second reforming zone. This is particularly advantageous when the second zone catalyst is a zeolitic catalyst and therefore especially sensitive to sulfur. Accordingly, in a preferred embodiment the present invention contemplates the use of a zeolitic catalyst in the second reforming reactor(s) guarded by a sulfur removal system located between the first reforming and the second reforming zone. U.S. Pat. No. 4,104,320 issued to Bernard et al. on Aug. 1, 1978 and U.S. Pat. No. 4,447,316 issued to Buss on May 8, 1984 (incorporated herein by reference) disclose the use of zeolitic reforming catalysts, especially in dehydrocyclization reactions.

The present invention contemplates the use of conventional bimetallic low pressure reforming catalysts, particularly in the first reforming zone. The most widely used reforming catalysts contain one or more platinum group metals associated with a porous solid carrier. Of the platinum group metals, platinum, palladium and iridium are preferred, and platinum is particularly preferred. The platinum group component is present in the catalyst in a concentration of about 0.01 to about 3 weight percent, preferably 0.01 to about 1 weight percent, based on the elemental metal. The porous solid carrier component of the catalyst is preferably an inorganic oxide, particularly one having a surface area of about 50 to 350 $m^2/g$. A particularly preferred surface area range is 150–250 $m^2/g$. The carrier can be a natural or synthetic inorganic oxide or mixture of inorganic oxides. Such materials as silica, alumina, silica-alumina, zirconia, magnesia, and crystalline aluminosilicate zeolites, or mixtures thereof, are suitable for use. It is particularly preferred that an alumina component be present in the carrier, either alone, or admixed with one or more other inorganic oxides. A suitable alumina carrier may be prepared in a number of ways known to those skilled in the art as, for example, by reaction of metallic alumina with hydrofluoric acid, acetic acid, etc., to form a hydrosol, which is then gelled with a suitable precipitating agent, such as ammonium hydroxide, followed by drying and calcining.

Other components in addition to the platinum group metal or metals, such as promoter metals, may be present in the catalysts. It is particularly preferred that rhenium be employed in the catalyst, for example, in an amount of about 0.01 to about 5 weight percent or more, preferably about 0.01 to about 2 weight percent, based on the elemental metal. Since rhenium significantly improves the yield stability of a platinum-containing catalyst, a catalyst containing both platinum and rhenium is particularly preferred for use in both the reforming system in the present process. A suitable platinum-rhenium catalyst is described in detail in U.S. Pat. No. 3,415,737 issued to Kluksdahl on Dec. 10, 1968. In addition to at least one platinum group metal and rhenium, the catalyst preferably contains a halide component, preferred halides being fluoride and chloride, particularly chloride. The catalyst preferably contains about 0.1 to about 3 weight percent total halide. A halide component can be incorporated into the catalyst at any suitable stage of catalyst manufacture, for example, prior to or following the incorporation of the platinum group compenent, the rhenium component or both. The halide compenent can also be incorporated into the catalyst at the same time as the platinum group component and/or rhenium component.

As mentioned above, the present invention is particularly advantageous when the catalyst in the second reforming zone is a zeolitic catalyst, especially if the catalyst comprises a large-pore zeolite. These large pore zeolite catalysts are particularly advantageous because they do not give rapid accumulation of coke even when operated at low pressure. Although these catalysts are particularly sensitive to sulfur, they can be guarded in the second reforming zone by a sulfur removal system located between the first and second reforming zones. The term "large-pore zeolite" is accepted by the art as a zeolite having an effective pore diameter of 6 to 15 Angstroms (Å).

Among the large-pored crystalline zeolites which have been found to be useful in catalysts in the second stage of the process of the present invention, type L-zeolite, zeolite X, zeolite Y and faujasite are the most important and have apparent pore sizes on the order to 7 to 9 Angstroms.

The chemical formula for zeolite Y expressed in terms of mole oxides may be written as:

$$(0.7\text{–}1.1)Na_2O:Al_2O_3:xSiO_2:yH_2O$$

wherein x is a value greater than 3 up to about 6 and y may be a value up to about 9. Zeolite Y has a characteristic X-ray powder diffraction pattern which may be employed with the above formula for identification. Zeolite Y is described in more detail in U.S. Pat. No. 3,130,007, hereby incorporated by reference.

Zeolite X is a synthetic crystalline zeolitic molecular sieve which may be represented by the formula:

$$(0.7\text{–}1.1)M[2/n]O:Al_2O_3:(2.0\text{–}3.0)SiO_2y:H_2O$$

wherein M represents a metal, particularly alkali and alkaline earth metals, n is the valence of M, and y may have any value up to about 8 depending on the identity of M and the degree of hydration of the crystalline zeolite. Zeolite X, its X-ray diffraction pattern, its properties, and method for its preparation are described in detail in U.S. Pat. No. 2,882,244, hereby incorporated by reference.

A preferred catalyst useful in the process of this invention comprises a type L-zeolite charged with one or more dehydrogenating constituents.

Type L-zeolites are synthetic zeolites. A theoretical formula is $M9/n[(AlO_2)_9(SiO_2)_{27}]$ in which M is a cation having the valency n.

The real formula may vary without changing the crystalline structure; for example, the mole ratio of silicon to aluminum (Si/Al) may vary from 1.0 to 3.5.

Although there are a number of cations that may be present in L-zeolite, in one embodiment, it is preferred to synthesize the potassium form of the zeolite, i.e., the form in which the exchangeable cations present are substantially all potassium ions. The reactants accordingly employed are readily available and generally water soluble. The exchangeable cations present in the zeolite may then conveniently be replaced by other exchangeable cations thereby yielding isomorphic form of L-zeolite.

When L-zeolite is prepared from reaction mixtures containing sodium, sodium ions are generally also included within the product as part of the exchangeable cations together with the potassium ions. The product obtained from the above ranges has a composition, expressed in terms of mole of oxides, corresponding to the formula:

$$0.9\text{–}1.3[(1-x)K_2O,\ xNa_2O]:Al_2O_3:5.2\text{–}6.9SiO_2:yH_2O$$

wherein "x" may be any value from 0 to about 0.75 and "y" may be any value from 0 to about 9.

A more complete description of these zeolites is given, e.g., in U.S. Pat. No. 3,216,789 which is hereby incorporated by reference.

Type L-zeolites are conventionally synthesized largely in the potassium form, i.e., in the theoretical formula given previously, most of the M cations are potassium. The M cations are exchangeable, so that a given type L-zeolite, e.g., a type L-zeolite in the potassium form, can be used to obtain type L-zeolites containing other cations, by subjecting the type L-zeolite to ion exchange treatment in an aqueous solution of appropriate salts. However, it is difficult to exchange all of the original cations, since some exchangeable cations in the zeolite are in sites which are difficult for the reagents to reach.

The zeolitic reforming catalysts useful in the present invention are charged with one or more Group VIII catalytic metals, e.g., ruthenium, rhodium, palladium, iridium or platinum.

The preferred Group VIII metals are iridium, palladium, and particularly platinum, which are more selective with regard to dehydrocyclization and are also more stable under the dehydrocyclization reaction conditions than other Group VIII metals.

The preferred percentage of platinum in the catalyst is between 0.1% and 5%, more preferably from 0.1% to 1.5%.

Catalytic metals are introduced into the zeolite by synthesis, impregnation or ion exchange using an aqueous solution of an appropriate salt. When it is desired to introduce two catalytic metals into the zeolite, the operation may be carried out simultaneously or sequentially.

By way of example, platinum can be introduced by impregnating the zeolite with an aqueous solution of tetrammineplatinum (II) nitrate, tetrammineplatinum (II) hydroxide, dinitrodiamino-platinum or tetrammineplatinum (II) chloride. In an ion exchange process, platinum can be introduced by using cationic platinum complexes such as tetrammineplatinum (II) nitrate.

The following Example illustrates a hypothetical embodiment of the present process. From the Example it will be apparent to those skilled in the field of the invention that the exemplified embodiment may be modified without departing from the characterizing features defined in the Claims which follow the Example.

EXAMPLE

Referring to the accompanying drawing, the hypothetical refinery operation schematically illustrated exemplifies a preferred embodiment of the present process. In this illustration naphtha feed to the first reforming zone, comprising three reactors in series, is mixed with a stream of hydrogen from a source described hereinafter and the mixture is introduced through line 1 via pump 20 into heat exchanger 30 and is heated. From heat exchanger 30 the heated mixture is passed through line 2 to furnace 40 and is heated to its contact temperature. The heated feed mixture is fed to the first reactor 100 of the first reforming zone wherein it is contacted with a reforming catalyst at conventional low pressure reforming conditions. The liquid effluent from reactor 100 is passed via line 3 through furnace 50 where it is heated and passed to the second reactor 200 of the first reforming zone. In the second reactor 200 the effluent is again contacted with a reforming catalyst at conventional low pressure reforming conditions. The liquid effluent from reactor 200 is passed via line 4 through furnace 60 where it is heated and passed to the third and final reactor 300. The reaction product from the first reforming zone is removed from reactor 300 through line 5. The hot liquid product is passed through heat exchanger 30 and via line 6 to cooler 70. The cooled, partially condensed, product is then passed via line 7 to a pressure separator vessel 80. In the pressure separator a hydrogen-containing gas phase is separated from a liquid hydrocarbon product phase. The hydrogen-containing gas phase is removed through line 8 to compressor 90, wherein the gas is compressed to a higher pressure and after a portion is drawn off as the net $H_2$ product, the remainder of this gas is then passed through line 9 into line 1 where it mixes with the naphtha feed for use in reforming operations.

The liquid hydrocarbon phase in separator vessel 80 is removed via line 10 to the second reforming zone comprising two parallel reactors. The product of the first reforming zone is thus passed via line 10 through heat exchanger 31 where it is heated and passed via line 11 to furnace 41. In furnace 41 the liquid product of the first reforming zone is heated to the desired reforming temperature and removed via line 13 or 14 to reactor 101 or reactor 201 where it is contacted with a reforming catalyst under reforming conditions which include a pressure below that of the first reforming zone. Reactors 101 and 201 are operated in parallel arrangement to permit swing operation from one reactor to the other. In this manner the reforming catalyst in reactor 101 can be isolated and regenerated, using auxiliary piping not shown, while reforming operations are conducted in reactor 201, and vice versa. The product effluent is removed from the active reactor via line 15 and passes through heat exchanger 31 via line 16 to cooler 71 where it is cooled and partially condensed. The cooled, partially condensed, effluent is then passes via line 17 to pressure separator vessel 81. In separator vessel 81 a hydrogen-containing gas phase is separated from a liquid hydrocarbon product phase. The hydrogen-containing gas phase is removed via line 18 to compressor 91, wherein the gas is compressed to a higher pressure and after a portion is drawn off as net $H_2$, the remainder of this gas then passes through line 19 into line 10 where it mixes with the first reforming zone product for further reforming operations.

The liquid hydrocarbon product phase of the second reforming zone is removed from separator 81 and withdrawn from the process. The product may, if desired, be passed to further conventional separation and/or purification operations.

This Example illustrates a single embodiment of the present invention. The following claims should not be construed to be limited by the Example.

What is claimed is:

1. A process for reforming a hydrocarbon feedstock which comprises the steps of:

A. contacting said feedstock and a first hydrogen-containing gas with a reforming catalyst, wherein said catalyst is bifunctional and comprises one or more platinum group metals supported on a porous alumina carrier, under reforming conditions including a first reforming pressure of about 200 psig in a first reforming zone said reforming zone comprises at least two reactors in series such that the effluent from the outlet of preceding reactor is fed directly to the inlet of a succeeding reactor;

B. separating a first hydrogen-containing gas phase and a first liquid hydrocarbon product phase from the effluent from said first reforming zone;

C. recycling at least a portion of said first gas phase to provide said first hydrogen-containing gas passed into said first reforming zone;

D. contacting said first product phase in the presence of hydrogen with a desulfurization catalyst to produce a desulfurized product phase;

E. contacting said desulfurized first product phase and a second hydrogen-containing gas with a reforming catalyst, wherein said catalyst is monofunctional and comprises a platinum group metal supported on a large pore zeolite, under reforming conditions including a second reforming pressure ranging from about 75 psig to about 125 psig said reforming zone comprises at least two reactors in parallel such that a given reactor can be isolated for regeneration while the other reactor remains in service;

F. separating a second hydrogen-containing gas phase and a second liquid hydrocarbon product phase from the effluent of said second reforming zone;

G. recycling at least a portion of said second gas phase to provide said second hydrogen-containing gas passed into said second reforming zone; and H. recovering said second liquid product phase.

2. A process according to claim 1 wherein the catalyst in said second reforming zone comprises one or more platinum group metals supported on a porous solid carrier.

3. A process according to claim 1 wherein the reforming conditions of said first reforming zone include a hydrogen-hydrocarbon mole ratio of from about 3:1 to about to about 10:1, and the reforming conditions of said second reforming zone include a hydrogen-hydrocarbon mole ratio of from about 1:1 to 3:1.

* * * * *